United States Patent [19]

Furness et al.

[11] 4,407,678

[45] Oct. 4, 1983

[54] SLUDGE REMOVAL MACHINE

[75] Inventors: John A. Furness, Addiscombe; John Haggerty, Warlingham, both of England

[73] Assignee: Butterworth Systems Inc., Florham Park, N.J.

[21] Appl. No.: 301,414

[22] Filed: Sep. 11, 1981

[30] Foreign Application Priority Data

Sep. 12, 1980 [GB] United Kingdom ..... 8029639

[51] Int. Cl.[3] ..... B08B 3/02; B08B 9/08

[52] U.S. Cl. ..... 134/167 R; 134/178; 239/240

[58] Field of Search ..... 134/167 R, 168 R, 178, 134/181; 239/240, 241

[56] References Cited

U.S. PATENT DOCUMENTS

| | | | |
|---|---|---|---|
| 2,116,935 | 5/1938 | Richard et al. | 134/167 R X |
| 2,991,203 | 7/1961 | Veld et al. | 134/24 |
| 3,523,647 | 8/1970 | Radecki | 239/241 X |
| 3,544,012 | 12/1970 | McNally | 239/240 X |
| 3,878,857 | 4/1975 | Heibo | 134/167 |
| 3,895,756 | 7/1975 | Jaeger | 134/167 R X |
| 3,953,226 | 4/1976 | Emond et al. | 134/104 |

FOREIGN PATENT DOCUMENTS

| | | |
|---|---|---|
| 2183918 | 12/1973 | France . |
| 1347628 | 2/1972 | United Kingdom . |

*Primary Examiner*—Robert L. Bleutge
*Attorney, Agent, or Firm*—Donald F. Wohlers

[57] ABSTRACT

A machine (1) suitable for removing sludge from the bottom of a storage tank which comprises a central body (15) rotatable about which is a casing (2, 3) provided with two substantially diametric nozzles (4, 5) arranged so that liquid emerging therefrom sweeps substantially only in one plane, a turbine (12) rotating the casing about the central body (15) and means (18) ensuring that when the casing (2, 3) is continuously rotated, alternately one nozzle is closed for substantially 180° rotation while the other nozzle is open. Such machines may be suspended above the floor of the tank adjacent to a wall thereof.

11 Claims, 4 Drawing Figures

SLUDGE REMOVAL MACHINE

This invention concerns a tank cleaning machine, especially for removal of sludge from the bottom of a storage tank and also to prevent sludge from re-precipitating on the bottom.

The accumulation of sludge on the bottom of crude oil storage tanks results in a number of operational problems, for example the capacity of the storage tank is reduced, 'dams' formed by the sludge deposits may trap pools of water which later form water slugs in the outflow from tank, the sludge causes uneven landing of the legs of the floating roof and alternative use of the tank for other oil types and products is prevented. The sludge accumulates despite the operation of normal tank mixers and it must be periodically removed by physically entering the storage tank. This is costly, a potential hazard to personnel and gives rise to problems with the disposal of large amounts of sludge.

We have now devised a machine which enables sludge removal without tank entry, by the use of a submerged jet.

According to this invention a machine suitable for removing sludge from the bottom of a storage tank comprises a central body rotatable about which is a casing provided with two substantially diametric nozzles arranged so that liquid emerging therefrom sweeps substantially only in one plane. There is also a turbine rotating the casing about the central body and means ensuring that when the casing is continuously rotated, alternately one nozzle is closed for substantially 180° rotation whilst the other nozzle is open.

Using this machine crude oil from the storage tank may be recirculated through the machine and the jet produced by the rotating nozzle re-suspends the sludge in the crude oil and thus facilitates removal or disposal by subsequent processing.

The central body will inevitably be circular in cross-section and is conveniently a disc which is stationary when the machine is in use. This body, e.g. disc, is usually bolted to the inlet pipework. Since the machine is designed to be suspended above but near the floor of a storage tank, this pipework will usually be fixed to the top of the machine. Alternatively this machine could be used upside down with the inlet on the bottom.

Although the machine is primarily designed to be suspended just above the floor of the storage tank it is possible for it to sit on a base in which case the base will have to be designed to cope with the fact that the floor of a storage tank is often sloping, e.g. the base will have adjustable legs.

The casing rotatable about the central body is preferably cylindrical and is provided with two substantially diametric nozzles. These nozzles should preferably be situated so that when the machine is suspended above or seated on the floor of a storage tank and the nozzles rotate the jet of liquid is between 20 cm and 40 cm above the floor of the tank. If the machine sits on a base, the casing will have to be free to rotate with respect to the base, e.g. it will be free to rotate within a circular recess.

The nozzles are arranged so that liquid emerging therefrom sweeps substantially only in one plane. When the machine is operating and suspended above or seated on the bottom of the tank it is preferable that the jets are substantially parallel to the bottom wall of the tank and so the nozzles should be designed to project substantially at right angles to the longitudinal axis of the machine.

The shape of the nozzles is not critical but it is convenient if they are shaped like truncated cones tapering towards their extremities, the taper ensuring that the jet of liquid emerging has a comparatively small angle of spread.

It is essential that when the machine is in use liquid emerges substantially only from one nozzle at a time. This is necessary because the machines are usually located near the wall of the tank and it is highly desirable to prevent a jet of liquid emerging from a nozzle impinging on the tank wall at close quarters with possible damage to the tank wall. Accordingly it is preferred that the machine be located within a tank adjacent to the side wall thereof and arranged so that when the machine is operating substantially no liquid impinges on the side wall to which the machine is adjacent.

This blanking mechanism can take various forms but one simple form is to extend the central body, e.g. disc, along the longitudinal axis of the machine with a substantially half cylinder which is also housed within the casing, the half cylinder being large enough to shut off the inlet to one of the nozzles as the casing rotates. This means that liquid entering the machine and flowing within the casing and towards the nozzles will only be able to emerge laterally from the casing over an arc which is generally no more than 180°. It is only when one of the nozzles rotates through this arc that liquid can emerge from the machine, i.e. through one of the nozzles. In practice it is preferred that the half cylinder be somewhat greater than a half cylinder i.e. extend through an arc of 180° to 200°. However in some cases the arc could be anything between 160° and 200°.

An alternative arrangement is for the central body to be in the form of a cylinder with a window therein extending round the wall of the cylinder for approximately 180° and being positioned so that when the casing rotates about this cylinder liquid can emerge from the window and through a nozzle.

In order to be able to rotate the casing about the central body, a turbine is necessary and it is preferred that the casing houses the turbine which is rotated by flow of liquid through the machine. The turbine shaft usually has a gear and through a gear train the casing is caused to rotate about the central body. In the preferred embodiment the turbine is located in the upper part of the machine above the disc constituting the central body and within the substantially half cylinder. The turbine shaft extends downwards through an aperture in the disc and at its lower end is provided with a gear, for example a worm which engages with a gear train, rotation of which causes the casing to rotate about the central body, e.g. the disc.

The speed of rotation of the machine is fairly critical and in practice it is found desirable that when used for removal of sludge from the bottom of a storage tank, the casing makes one complete revolution in between 2 and 4 hours, e.g. about 3 hours.

Although in some cases one machine may be quite sufficient for cleaning the sludge from the bottom of a storage tank it may often be desirable or even necessary to use more than one such machine. One convenient arrangement when cleaning a tank having a circular side wall is to use two but preferably three, substantially equispaced machines suspended above the floor of the tank and adjacent to the wall. The sweep of the nozzle from each machine will cover the whole of the floor of the tank with little overlap of each sweep. Generally, the number of machines required depends on the size of the tank and the pumping capacity available.

Although the turbine is usually powered by recirculating the oil the turbine could be supplied with water under pressure, e.g. 6 to 14 kg/cm$^2$. This may if desired be heated and may contain a detergent, a chemical emulsifier or demulsifier. If it was then desired to use the tank again for oil storage all traces of water would have to be removed before re-using the tank.

The invention is now described with reference to the drawings in which.

and

Figure 4:
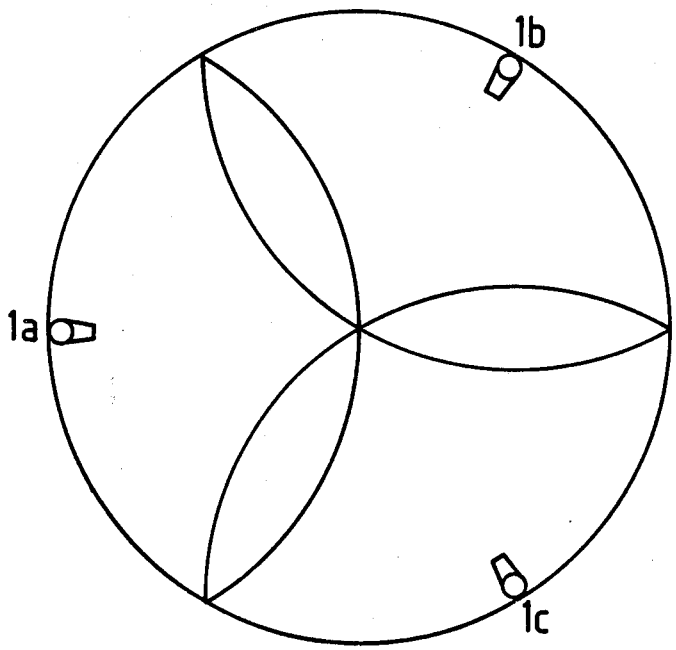

FIG. 4 is a plan view of the three sludge removing machines installed suspended above the floor of the circular tank.

Figure 1:
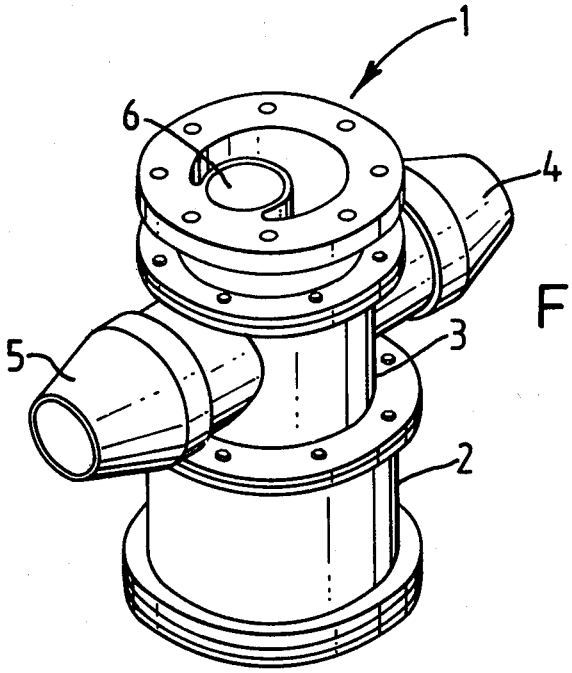
FIG. 1 shows a view in perspective of a sludge removing machine.
Figure 2:
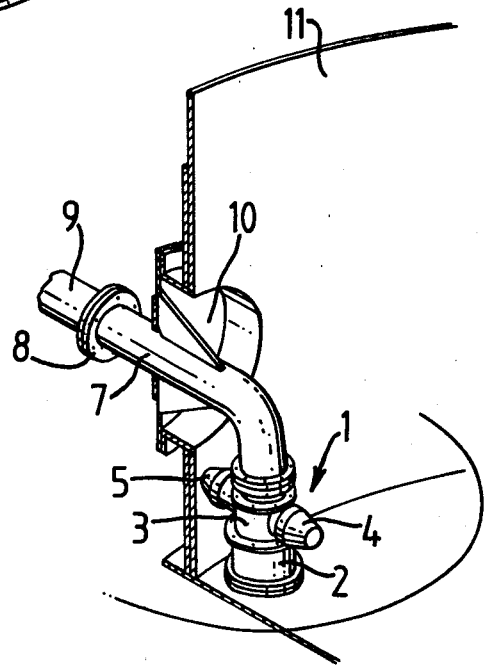
FIG. 2 shows this machine installed suspended above the floor of a circular tank, the wall of which is part cut away.

Referring to FIGS. 1 and 2 of the drawings the sludge removing machine 1 comprises a rotatable casing having a lower portion 2 and an upper portion 3 to which two nozzles 4 and 5 are attached. The axis of the nozzles 4 and 5 is substantially at right angles to the longitudinal axis of the machine.

The sludge removing liquid, for example oil, enters the machine at the top (at 6 in FIG. 1) via the elbow pipe 7. This pipe 7 passes through an aperture 10 of the wall 11 of the tank and is provided with a flange 8 to which another pipe 9 is attached.

Figure 3:
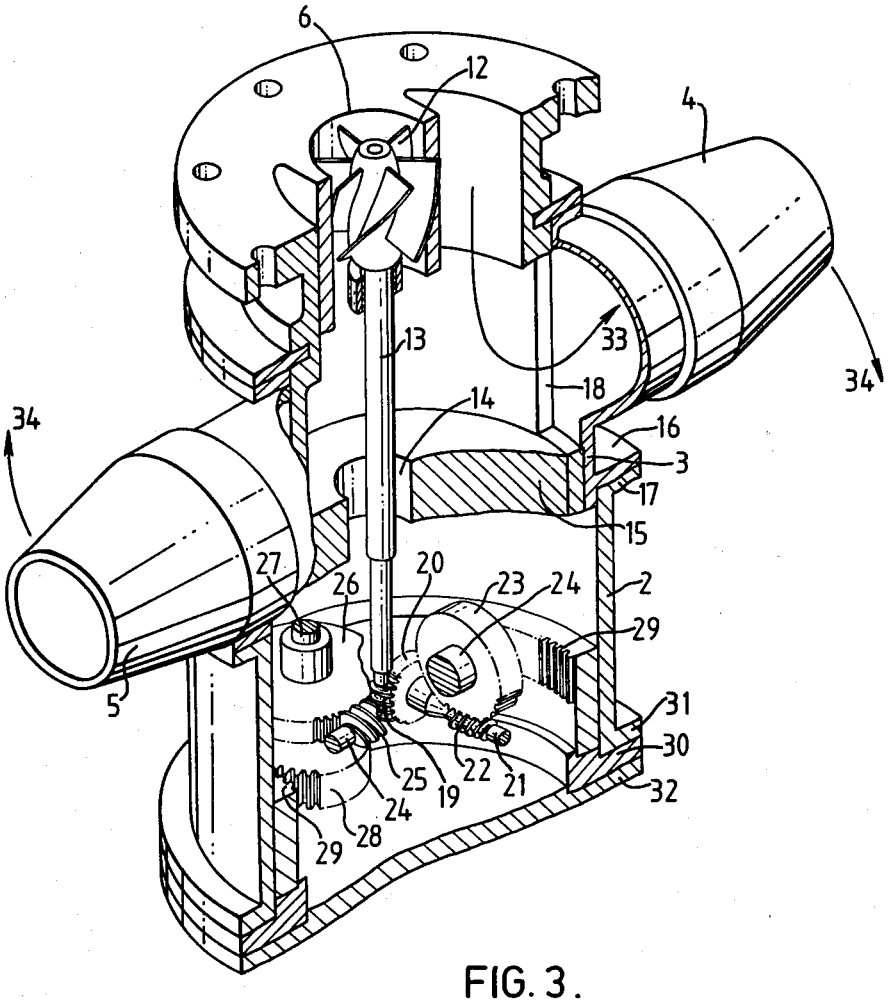
FIG. 3 shows a view of the sludge removing machine in part section.

Referring now to FIG. 3 within the opening 6 at the top of the machine there is a turbine 12 having a shaft 13. This shaft 13 passes through an aperture 14 in a disc 15. The upper and lower portions 3 and 2 of the casing are connected together by flanges 16 and 17. In the annular space between portion 3 of casing and disc 15 there is a half cylindrical casing 18 which extends upwards from the disc 15. Although casing 18 is substantially half-cylindrical, in the immediate proximity of the disc 15 it does completely envelope the disc 15 and therefore completely occupies the annular space between disc 15 and portion 3 of casing. This casing 18 is fixed to disc 15 by welding but the upper and lower portions (3 and 2) of the outer casing bolted together at their flanges 16 and 17 are free to rotate about the casing 18.

The lower end of the shaft 13 is provided with a worm 19 which meshes with worm wheel 20. This worm wheel 20 is carried on shaft 21 the other end of which is worm 22. This worm 22 engages with worm wheel 23 and is carried on shaft 24, part of which is broken away for clarity. This shaft 24 carries a worm 25 which engages with worm wheel 26 carried on shaft 27. This shaft 27 also carries a spur gear 28 and this engages with a ring gear 29. This ring gear 29 is bolted to the ring 30 which in turn is bolted to flange 31 of lower portion 2 of the rotatable casing and to the base plate 32.

The machine operates as follows:

The oil is recirculated, entering the machine 1 through aperture 6 and causing turbine 12 to rotate. As the turbine shaft 13 rotates by means of worm 19, 22 and 25, worm wheels 20, 23 and 26, spur gear 28 and ring gear 29 the outer casing rotates about the disc 15 and half cylinder 18. Since the nozzles 4 and 5 are attached to upper portion 3 of the outer casing they also rotate in a substantially horizontal plane as shown at 34. Since these nozzles 4 and 5 are diametrically placed the flow of oil shown at 33 can only enter one nozzle at a time (as shown in FIG. 3, nozzle 4). As the nozzles rotate in the horizontal plane eventually the entry to nozzle 5 will be free of blanking by casing 18 and oil will enter this nozzle 5. At the same time the entry to nozzle 4 will be blanked off by casing 18 and so oil will be unable the enter nozzle 4. In this manner as the nozzles rotate oil will emerge from only one nozzle at a time.

FIG. 4 shows three equispaced sludge removal machines 1*a*, 1*b* and 1*c*. Provided there they are correctly orientated so that substantially no oil emerges from a nozzle directly pointing at the side wall, it can be seen that substantially the whole of the diameter of the tank bottom is swept by oil emerging from the three machines.

We claim:

1. A machine suitable for removing sludge from the bottom of a storage tank which comprises a central body, a casing rotatable about said body and provided with two substantially diametric nozzles arranged so that liquid emerging therefrom sweeps substantially only in one plane, a turbine for rotating the casing about the central body and means ensuring that when the casing is continuously rotated, alternately one nozzle is closed for substantially 180° rotation whilst the other nozzle is open.

2. A machine according to claim 1 wherein the nozzles project substantially at right angles to the longitudinal axis of the machine.

3. A machine according to claim 2 wherein the central body comprises a disc attached to which is a substantially half cylinder large enough to shut off the inlet to one of the nozzles as the casing rotates.

4. A machine according to claim 3 wherein the half cylinder extends through an arc of 180° to 200°.

5. A machine according to claim 1 or claim 2 wherein the nozzles are shaped as truncated cones tapering towards their extremities.

6. A machine according to claim 1 wherein the turbine shaft is provided with a worm which engages with a gear train, rotation of which causes rotation of the casing about the central body.

7. A storage tank having a machine located within the tank adjacent to the side wall thereof, said machine comprising a central body, a casing rotatable about said body and provided with two substantially diametric nozzles arranged so that liquid emerging therefrom sweeps substantially only in one plane, a turbine for rotating the casing about the central body and means ensuring that when the casing is continuously rotated, alternately one nozzle is closed for substantially 180° rotation whilst the other nozzle is open, said machine being arranged so that when it is operating substantially no liquid impinges on the side wall to which the machine is adjacent.

8. A storage tank according to claim 7 which has a circular side wall and wherein there are three substantially equispaced machine suspended above the floor of the tank and adjacent to the wall.

9. In combination, a storage tank and at least one machine for directing liquid located within the tank adjacent to a side wall thereof, each said machine comprising a central body, a casing continuously rotatable about said body and provided with two substantially diametric nozzles arranged so that liquid emerging therefrom sweeps substantially only in one plane, a turbine for rotating the casing about the central body and blanking means on said body ensuring that when the casing is continuously rotated, alternately one nozzle is closed for substantially 180° rotation whilst the other nozzle is open, said machine being arranged so that when it is operating substantially no liquid impinges on the storage tank side wall adjacent said machine.

10. The combination of claim 9 wherein said storage tank is cylindrical in shape and employs three machines symmetrically disposed about the base of said tank at 120 degree spacings from each other.

11. The combination of claim 10 wherein the plane of the sweep of the liquid emerging from each nozzle is substantially parallel to the plane of the bottom of said storage tank.

* * * * *